US005180461A

United States Patent [19]

Widmann

[11] Patent Number: 5,180,461

[45] Date of Patent: Jan. 19, 1993

[54] APPARATUS TO APPLY REINFORCEMENTS ON FILING GUIDES OR INSERTS, AND METHOD

[75] Inventor: Werner Widmann, Plochingen, Fed. Rep. of Germany

[73] Assignee: Karl Widmann Schweissmaschinen GmbH, Schlierbach, Fed. Rep. of Germany

[21] Appl. No.: 561,453

[22] Filed: Aug. 1, 1990

[30] Foreign Application Priority Data

Oct. 13, 1989 [DE] Fed. Rep. of Germany ..... 3934217

[51] Int. Cl.[5] ..... B26D 5/00

[52] U.S. Cl. ..... 156/216; 53/580; 156/354; 156/355; 156/464; 156/521; 156/571

[58] Field of Search ..... 156/354, 355, 362, 361, 156/358, 353, 464, 571, 461, 465, 521, 510, 516, 475, 479, 216, 443; 53/580, 585, 224, 225

[56] References Cited

U.S. PATENT DOCUMENTS

| | | | |
|---|---|---|---|
| 2,626,074 | 1/1953 | Vogt | 156/571 X |
| 2,885,847 | 5/1959 | Sramek | 53/580 X |
| 2,985,991 | 5/1961 | Habgood | 53/225 X |
| 3,850,775 | 11/1974 | Bruneau | 156/463 |
| 3,926,713 | 12/1975 | Lowe et al. | 156/510 |
| 4,588,463 | 5/1986 | Barber et al. | 156/200 |
| 4,605,459 | 8/1986 | Voitmer et al. | 156/521 X |

FOREIGN PATENT DOCUMENTS 1208729 1/1966 Fed. Rep. of Germany .

*Primary Examiner*—David A. Simmons
*Assistant Examiner*—William J. Matney, Jr.
*Attorney, Agent, or Firm*—Frishauf, Holtz, Goodman & Woodward

[57] ABSTRACT

To apply a reinforcing element (9) only at the position of an index tab (7) on stock material, in which the position of the index tab, for example alphabetically, shifts from stock material to stock material, the stock material (2) is passed through a groove (27, 27*a* . . . 27*f*) extending axially along a cylinder or drum (22), the reinforcements being derived upon cutting a ribbon (15) which is folded longitudinally, and inserted into a groove (27*e*) of the cylinder while the reinforcement at the opposite side of the cylinder is being applied on the stock material, slid into the groove by a transport system. For application, heated tines press, from the top and bottom, against the reinforcement, by passing through circumferential grooves (69) of the drum or cylinder (22). A movable stop system (17) longitudinally positions the stock material (2) for staggered application of the reinforcements.

52 Claims, 6 Drawing Sheets

APPARATUS TO APPLY REINFORCEMENTS ON FILING GUIDES OR INSERTS, AND METHOD

Reference to related patent, the disclosure of which is hereby incorporated by reference: U.S. Pat. No. 4,588,463.

Reference to related publication: German Patent Disclosure Document 20 19 711, Falkner.

FIELD OF THE INVENTION

The present invention relates to an apparatus to apply reinforcements to paper or cardboard stock material which is suitable for use as filing guides or inserts, and especially to filing guides which have projecting index tabs, for example alphabetical tabs, numerical tabs and the like.

BACKGROUND

Indexing tabbed filing guides may be used with file folders or, later on, can be folded to form file folders; they usually have projecting tabs with index markers thereon, for example the letters of the alphabet, numbers, or blank tabs for later application of adhesive strips with suitable identification of contents, or they may carry symbols or other recognition markers.

The tabs are stressed mechanically since they extend laterally from a stack of filing guides. To open the specific file, it is customary to grasp the file or guide at the tab. To prevent soiling, and to ensure integrity of the tab, it is necessary to reinforce the material in the region of the tab. The reinforcement should cover the tab and adjacent regions of the file guide, to protect the entire file guide against premature destruction and against damage. The reinforcements are applied by a machine to the file guides.

THE INVENTION

It is an object to provide a machine or apparatus which can apply reinforcements to file guides, having tabs, which is simple, essentially breakdown-free, and can operate at high speed without breakdown, and to place reinforcement on tabbed guides which are staggered longitudinally, in which adjustment apparatus of only low mass need be shifted so that high adjustment speed is obtained.

Briefly, a rotatable gripper element which is formed with at least one, and preferably a group of axially extending grooves, is rotatable about an axis under control of a motor, for example a stepping motor. The grooves can be brought, respectively, in alignment with a folded supply ribbon of reinforcing material and, upon rotation, then placed in the path of transport of stock material from which the guides are later punched. To place the reinforcements longitudinally in appropriate positions for, for example, alphabetical index markers, abutment means are placed in the path of movement of the stock material, the abutment means themselves being shiftable longitudinally under control of a motor, coupled to the abutment means. Preferably, the motor is a stepping motor so that the abutment means moves, each time, by a predetermined distance corresponding to an offset spacing of the letters of the alphabet, for example.

The gripper element, preferably, is an essentially cylindrical body formed with axially extending V-grooves, and additionally with circumferential grooves. A V-groove at, for example, a position remote from the transport path of the stock material, receives the reinforcing ribbon which is cut, and the gripper is then rotated. When the groove, now retaining a cut reinforcing ribbon element, reaches the path of the stock material, a comb-like compression unit is pressed through the circumferential grooves, from the top as well as from the bottom, against the tab element to preliminarily adhere it to the stock material. The stock material, of course, has been fed to the predetermined position with respect to the rotatable gripper element so that the cut reinforcing element is placed at the appropriate position on the stock material.

Use of a rotatable gripper which receives the reinforcements in axially extending grooves has the advantage that the movement to apply the reinforcement on the stock material can utilize the movement of the stock material at its transport through the machine. A separate translatory movement of the gripper to place the reinforcement on and about the edge portion of the stock material is not needed. This arrangement, thus, only requires aligning the groove, with the cut reinforcing element therein, and spread apart in V-shape, with the transport path of the stock material which is stopped for an instant only during adhesion of the reinforcing material, for example by heated compression combs. The compression combs reciprocate against and away from the stock material and as soon as they have left the stock material, the cylinder can rotate to a next groove to receive a next element of stock material, requiring only very little time for cycling of application of the cut element. Only small masses need to be accelerated and retarded. In a rotary movement, an additional advantage is obtained since it can be easily obtained from a rotary motor, achieving high precision and involving low running friction.

The groove formed in the gripper body preferably is V-shaped, which effectively eliminates incorrect placement of the reinforcing element which, otherwise, might lead to dead spaces, or a gap between the edge of the reinforcement and the edge of the file guide which is to be reinforced.

The reinforcement element, preferably a folded Mylar® or similar plastic ribbon, can be held with the V open against the groove, by the inherent resiliency of the reinforcing ribbon after folding, which will have the tendency to open up, but is held in engagement with the walls of the V-groove. Preferably, the end portions of the V-groove adjacent the circumference of the gripper body which, for example, is basically cylindrical, are formed with small projections which retain the cut reinforcing element in the groove.

DRAWINGS

DETAILED DESCRIPTION

Figure 1:
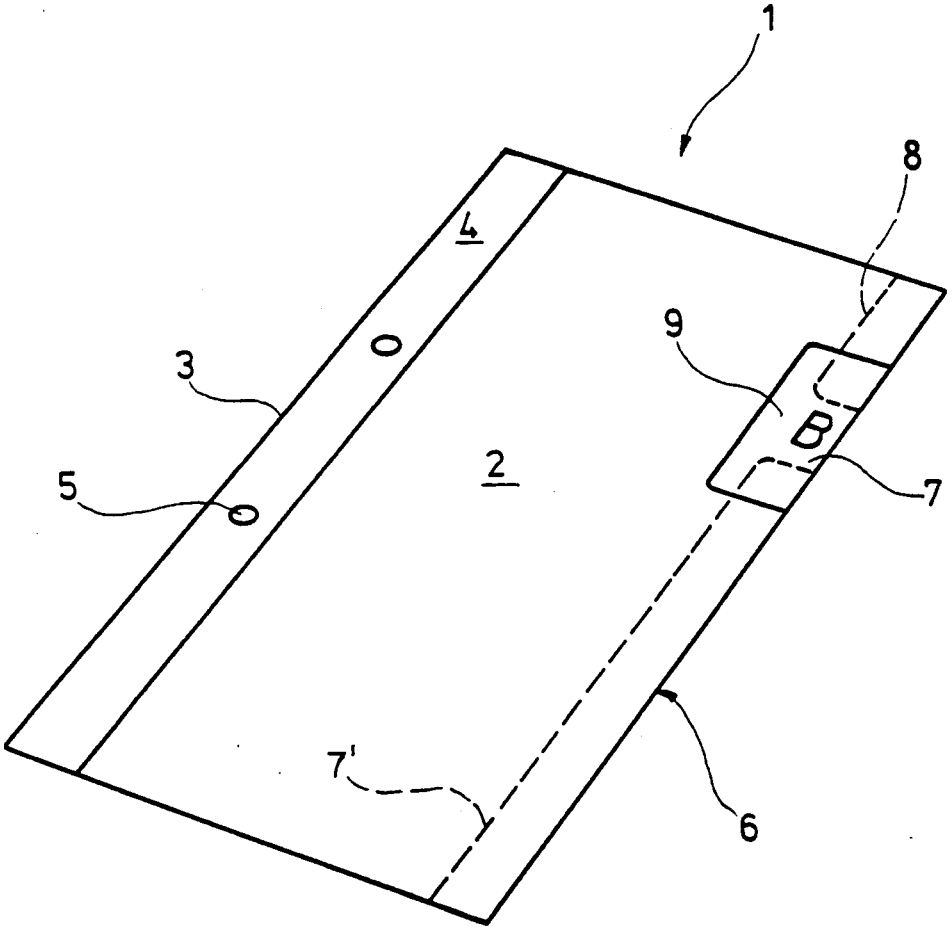
FIG. 1 is an isometric view of a file guide or file insert with a tab, and the stock material from which it is prepared.

A file guide 1, FIG. 1, is cut from a rectangularly cut sheet of paper, carton, light cardboard, plastic or the like, which is delivered in form of stock material 2. The file guide has a back edge 3 about which a continuous reinforcement strip 4 is folded in order to protect and reinforce holes 5, for example for placement in a ring binder or the like. The reinforcement 4 need not be applied to the back edge, but can be also applied to an edge at right angles thereto.

To cut the file guide, the front edge 6 thereof is severed along the cutting lines 7' and 8, leaving an index tab 7 which, for example, may carry an alphabetical marking, shown in FIG. 1 as B. The tab 7 projects laterally from the guide 1 after the cuts along lines 7', 8 have been made. To protect the tab 7, a reinforcing element 9 is applied to the edge 6 of the stock material 2, by looping a folded element about the edge 6. Parts of the element 9, after application, will be cut when making the cuts along the lines 7', 8. The folded reinforcement element 9 protects the front as well as the back side of the guide. The reinforcement part, which is cut out along the broken lines 7', 8, extends beyond the tab 7 to provide for a strong engagement and a back-up surface beneath the tab 7 and extending towards the central portion of the file guide.

The tab 9 may be applied by adhesion or heat-welded to the stock material 2. It is a unitary element, folded about the stock material.

As is customary in file guides, the position of the tab 7 at the front edge 6 is located in dependence on the symbol applied to the tab, that is the spacing of the tab 7 from the upper edge of the guide 1 differs in dependence on the particular symbol, in the illustration the letter of the alphabet. The reinforcement 9, thus, must travel along as the letters of the alphabet progress and are placed in sequentially staggered locations downwardly, with respect to FIG. 1. To avoid cutting off an entire reinforcement strip, that is, to reinforce only the region surrounding the tab, it is necessary to have the reinforcing element 9 applied at different longitudinal positions on the stock material 2.

Figure 2:
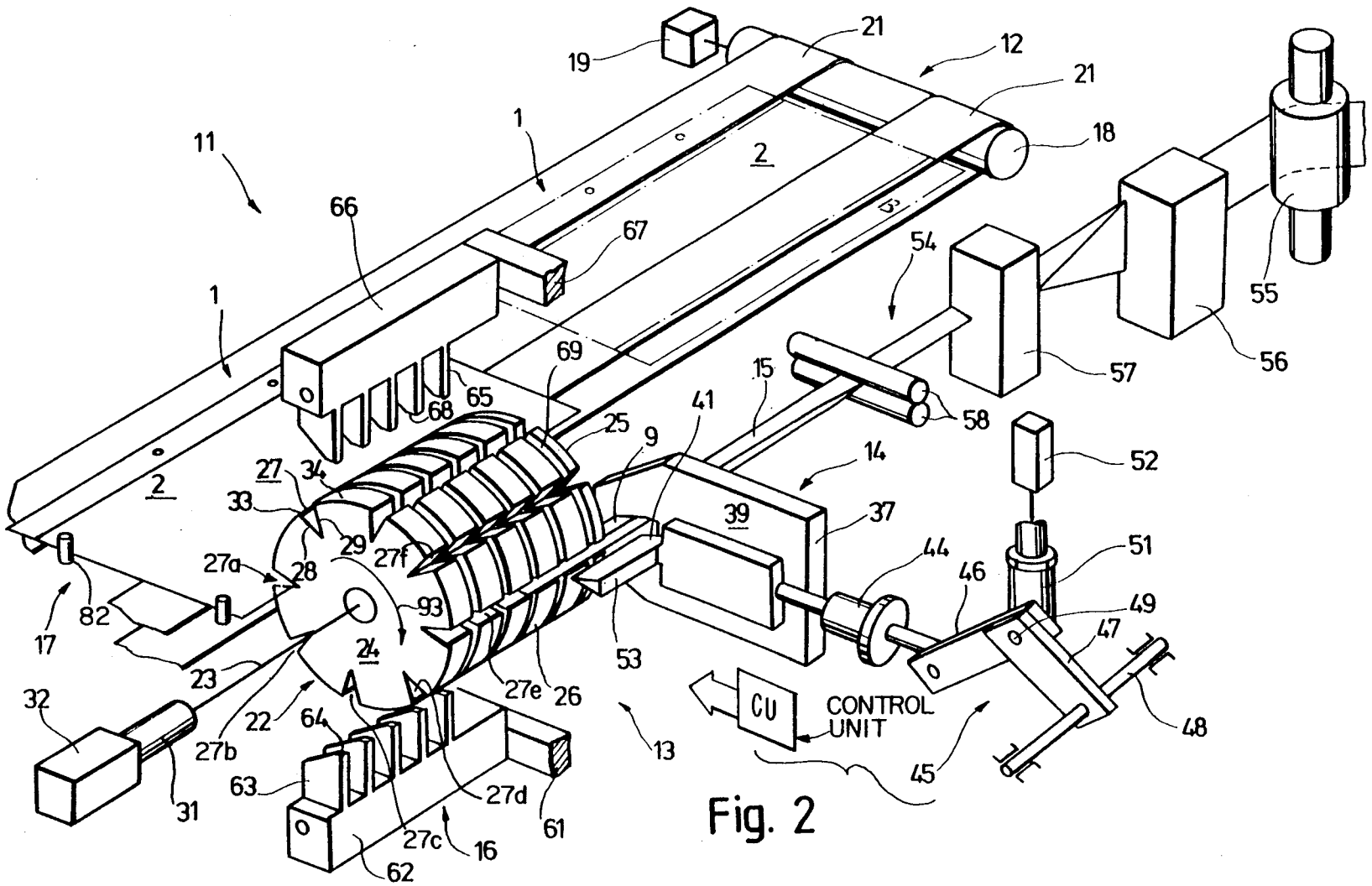
FIG. 2 is an isometric view of the apparatus, illustrating the major components and their association.

FIG. 2 illustrates an apparatus to apply the tab element 9 on the stock material 2 in highly schematic form, omitting all element not necessary for an understanding of the invention. Such components as bearings, frames and the like have been omitted from the illustration so as not to overload the drawing with details which are mere engineering or design matters and which are not necessary for an understanding of the overall construction and operation of the apparatus 11.

Essentially, the apparatus 11 to apply the tab has a transport portion 12 to transport the stock material 2, a tab supply apparatus 13 to supply tab elements 9 on and about the stock elements 2, a cutter 14 to cut the tab elements 9 from a supply strip 15, and application apparatus 16, in order to preliminary application of the tab elements 9 on the stock element 2, and a stop or abutment system 17 which appropriately aligns the position of the stock element 2 with respect to the tab supply element 13 so that the tab element 9 will be placed on the stock element 2 in an appropriate desired longitudinal position.

The transport system 12 has two parallel belts 21, looped about suitable deflection rollers, of which only one, roller 18, is shown. At least one of the deflection rollers is driven, as schematically indicated by motor 19, coupled to roller 18. Roller 18 is located upstream of the supply unit 13 with respect to the path of the stock elements 2 which travels from the upper right to the lower left, with respect to FIG. 2. Motor 19 selectively drives the roller 18.

The working run, in this case upper run of the belts 21 determines the transport path over which the stock material 2 is fed to the tab element application unit 13.

The tab element application unit 13 is located adjacent the right one of the belts 21, with respect to FIG. 2. It is an essentially cylindrical body, rotatable about an axis 23, retained in suitable bearings (not shown). The body or drum 22 forms a gripper or gripping element for the reinforcement elements 9 in order to transport them from a supply source to the stock material 2. The axis of rotation 23 of the drum 22 is parallel to the working run of the transport belts 21, and hence parallel to the path along which the stock material 2 is supplied to the application unit 13, and transported therethrough.

The cylindrical drum 22 has two parallel end faces 24, 25, an interrupted cylindrical outer surface 26 and a plurality of V-shaped grooves 27 formed therein, for example six or eight grooves. The grooves 27 are, in cross section, essentially V-shaped, pass through the end faces 24, 25 and have essentially flat side walls 28, 29 (FIG. 3) which diverge towards the outer circumference 26 of the drum 22. They are mirror symmetrical with respect to radii passing through the center of rotation 23 of the body 22 and the apex of the V of the respective groove.

The drum 22 only rotates; its axis of rotation does not shift and the drum 22 does not move axially. For rotation, a shaft 31 of a stepping motor 32 is coupled to the drum 22, to provide for indexed rotation of the drum 22 about the angular distance between adjacent grooves 27, and then stop rotation of the drum. The grooves 27 are located about the drum by equal angular distances so that the rotary angle about which the motor 32 has to rotate drum 22 is always the same.

Figure 3:
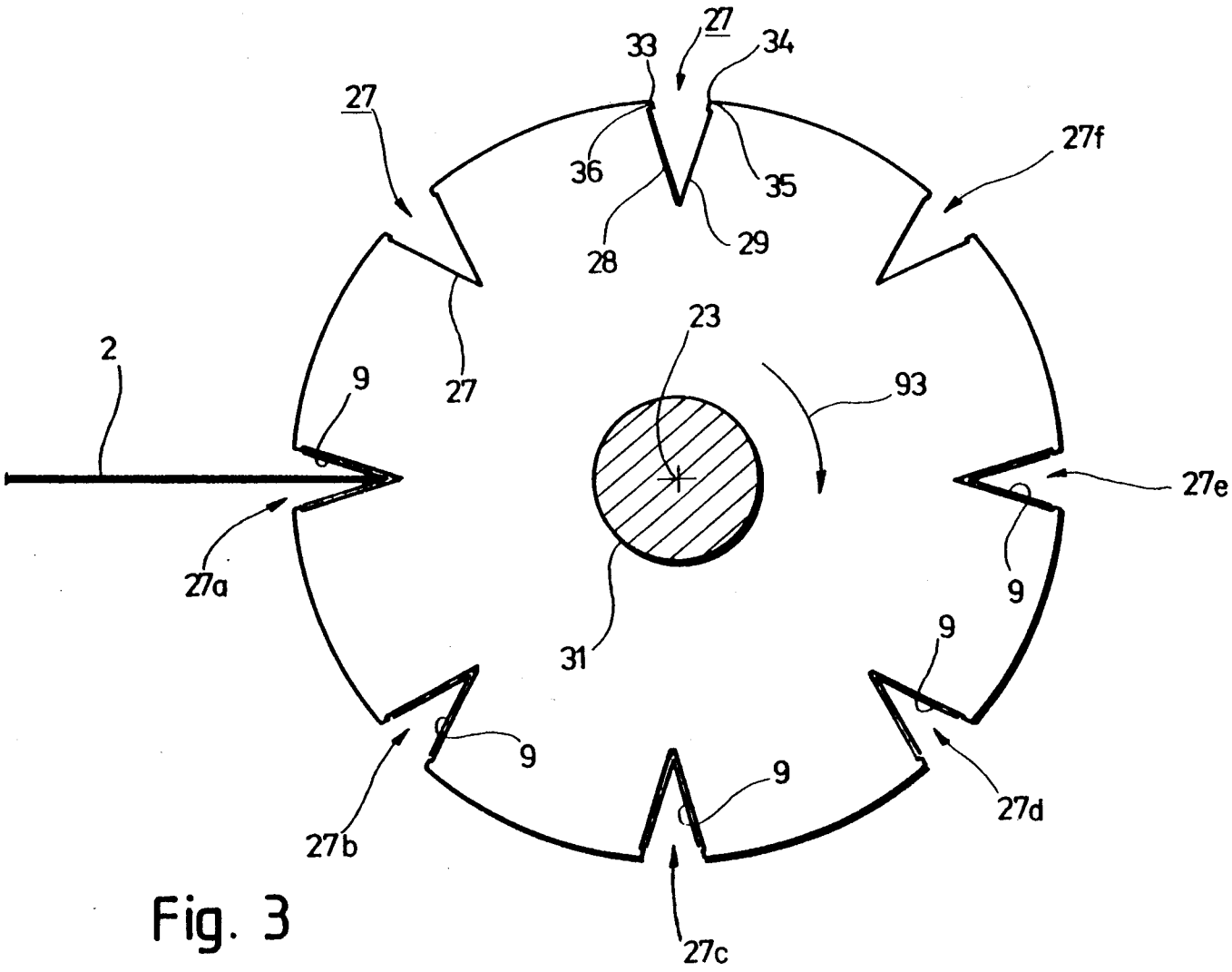
FIG. 3 is an end view of the rotary gripper.

The grooves 27 have the same cross-sectional shape and dimension throughout their length. They have edges 33, 34 adjacent the circumference 26 of the drum 22 which, consequently, will be uniformly spaced throughout the axial length of the body 22 and will be parallel to each other. As best seen in FIG. 3, the edges 33, 34 are inwardly extended with strip-like projections 35, 36 which slightly project inwardly of the groove from the respective wall 28, 29. These projecting strips or extension 35, 36 extend over the entire length of the groove 27. The projections 35, 36 are used to retain reinforcement elements 9 in the respective groove 27, as will appear in detail below.

Figure 4:
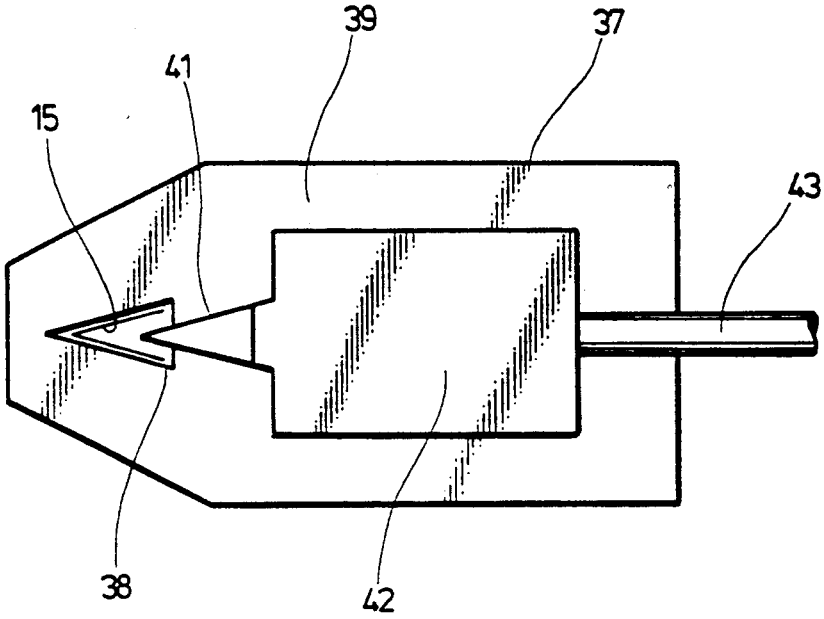
FIG. 4 is a detailed side view of the cutter.

The cutter 14 has a cutter plate 37 with a polished flat cutting surface 39 (FIG. 4), extending parallel to the end face 25 of the drum body 22. The cutter plate 37 is formed with a triangular opening 38, which has a shape similar to that of the grooves 27, but a slightly smaller opening angle than that of the grooves 27. The opening 38 is in alignment with any one groove position of the drum 22. It is spaced from the axis of rotation 23 slightly farther away than the groove 27 with which it is alignable. The purpose is to permit a folded strip 15 to pass without obstruction through the opening 38 and into an aligned groove 27 upon pushing of a folded strip through the opening 38.

A cutter blade 41 slides along the flat polished or ground surface 39 of the cutter plate 37. The blade 41 is formed or connected to a pusher element 42, which is coupled to a reciprocating movement, as will appear. The cutter blade 41, in plan view, corresponds essentially to the shape of the opening 38. The apex of the cutter blade 41 as well as the apex of the opening 38 point towards the axis of rotation 23.

The pusher 42 is reciprocating by being coupled to a push rod 43 which is longitudinally slidable in a bushing 44. Reciprocating motion is obtained by a two-linkage lever system 46, 47, 48, 49. The push movement is at right angles to the axis of rotation 23 of the drum 22. The two-lever system 46, 47 is coupled, respectively, to the push rod 43, pivoted to a fixed axis 48, and at the junction of the levers 46, 47, coupled to a cylinder-piston unit 51 which reciprocates in vertical direction. The piston rod 51 of the cylinder 52 is coupled, by a pivot joint 49, to the junction of the levers 46, 47 so that, upon vertical movement of the piston rod 51 under control of the cylinder 52, up-and-down movement of the piston rod 51 will lead to contraction or stretching of the double lever system 45, thereby pushing knife 41 in the direction towards the axis of rotation 23 of the drum 22 or, respectively, withdrawing the knife.

The knife 41 supports a wedge-shaped push element 53 which is in alignment with the respective groove 27 with which, also, the knife is aligned. Upon cutting movement of the knife 41 on the polished surface 39 of the cutter blade 37, the pusher 53 engages into the groove 27 almost entirely into the root thereof without, however, touching the root or the side surfaces 33, 34 of the groove, nor the inwardly extending projections or strips 35, 36.

A folded reinforcing ribbon or strip 15, supplied to the cutter, is cut off to form a reinforcing element 9, with a length corresponding to the length of the required reinforcing element 9. The strip 15 is moved in parallel, and synchronized with movement of the guide stock 2.

A supply roller supplies ribbon 15 of reinforcing material to a folding station 54 which folds the ribbon or belt-like strip 15, after deflection about a deflection roller 55 and after passage through a guide element 56, once, in longitudinal direction. The folding element may, for example, include a triangular or cone-shaped folding former coupled to or forming part of the folding station 57, which folds the two edges of the ribbon 15 towards each other. The then folded ribbon is pulled off by pull-off rollers 58, and the fold is compressed. The pull-off rollers 58, also known as pinch rollers, are driven by a suitable drive, not shown, in steps, in order to push the folded strip or ribbon 15 through the opening 38 of the cutter plate 37.

A suitable material for reinforcement is, preferably, Mylar®, which has inherent elasticity. Consequently, and after being folded and passing the pitch rollers 58, the folded ribbon will open up slightly in V-shape as seen in FIG. 2. Thus, the knife 41 (FIG. 4) can readily pass into the now open V and sever the respective legs of the ribbon 15. Each one of the legs of the ribbon 15, in V-shape, are thus cut and, further, by the cutting operation, the ribbon is forcibly opened. The cut edge may form a cutting burr or cutting ridge which, with the apparatus as described, will face outwardly and will not interfere with opening up of the ribbon 15 as it is being cut and, after cutting, to form the reinforcement element 9.

The cut reinforcement element 9 is held in the position required for application to the stock 2, and for placement at the appropriate position on the stock 2 by the extension 53.

After association of the reinforcement element 9 with a stock element 2, it is necessary to retain the reinforcement element at the selected position with respect to the guide element 1 to be formed. A preliminary attachment or securing or application unit 16 is provided, which has a plurality of comb or tine-like projections 63, which can pass within circumferential grooves 69 in the drum 22. The application apparatus has a lower, pivotably positioned arm 61, pivotable about a pivot axis extending parallel to the axis of rotation 23 of the drum 22. A bar 62 is attached to arm 61, extending parallel to the axis of rotation 23 and which carries, at its upper end, a plurality of comb-like narrow tines 63. In the embodiment shown, five tines are used. Each one of the tines 63 has a flat engagement surface 64 at the side remote from the bar 62. All the engagement surfaces 64 are in the same plane.

In a plane perpendicular to the plane of the stock sheet 2, a second similar application comb is positioned, retained on a bar 66 and having tines 65 with flat engagement surfaces 68. The bar 66 is parallel to the bar 62, spaced therefrom, and retained on an individual pivoting arm 67, pivotably secured to pivot about an axis parallel to the axis of rotation 23 of the drum 22. The tines 65 are similar to the tines 63 and are in vertical alignment therewith.

Circumferential grooves 69, formed in the drum 22, permit the tines 63 and the tines 65 to engage a reinforcement 9 held in a groove 27. The grooves 69 pass through and intersect all of the grooves 27 at the circumference of the drum 22. A drive apparatus, not shown and which can be of any suitable construction, moves the arms 61, 67 towards each other by pivoting them together. Thus, the two sets of tines 63, 65 can engage in the circumferential grooves 69 of the drum 22, one on either side of the stock sheet 2, in a position adjacent to the transport system 12. The tines can be heated, for example by a suitable heating system retained in or on the bars 62, 66.

The movable stop system 17 is provided so that the reinforcement 9 will be placed on the guide at the longitudinal position appropriate for the particular index marking. It is so arranged that the file guide 1 is fed by the transport belts 12 to the position opposite the drum 22 and stopped opposite the drum 22 in the respective position for the tab marking such that, after subsequent cutting of the tab, the tab will be in alignment with a reinforcing element 9 in one of the grooves 27 of the drum 22. Since the apparatus successively places reinforcements on guides which may be part of a complete set, it is necessary that the stop system 17 can move in the transport direction. Two immediately succeeding file guides 1 will have tabs 7 in different positions with respect to the end edges thereof. For example, if a set of guides 1 is to have tabs with the alphabets in conventional sequence, it is customary to first print the letter "Z" and to reinforce this letter. The stop system 17 thus must be in a position which ensures that the reinforcement 9 in a groove 27 of the drum 22 is in alignment with the tab carrying the letter "Z". The tab "Y" will be shifted somewhat upwardly in the direction of the top edge of the cut element 2, so that the stop system 17 must be shifted downstream, in the direction of feed of the cut element 2 by the offset required by the succeeding tab "Y" with respect to the prior tab "Z".

Figure 5:
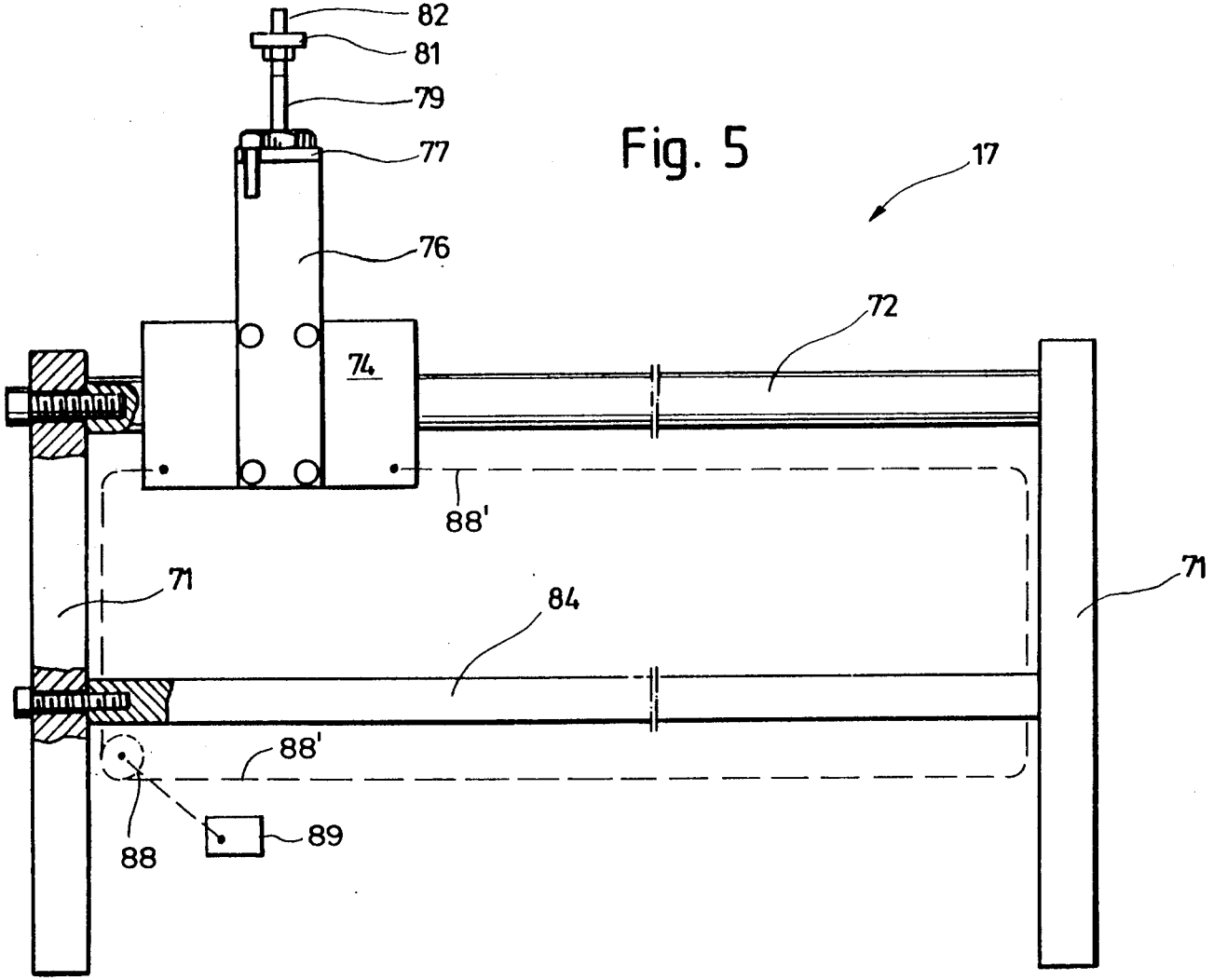
FIG. 5 is a fragmentary end view, partly in section, of the stop arrangement for the stock material.
Figure 6:
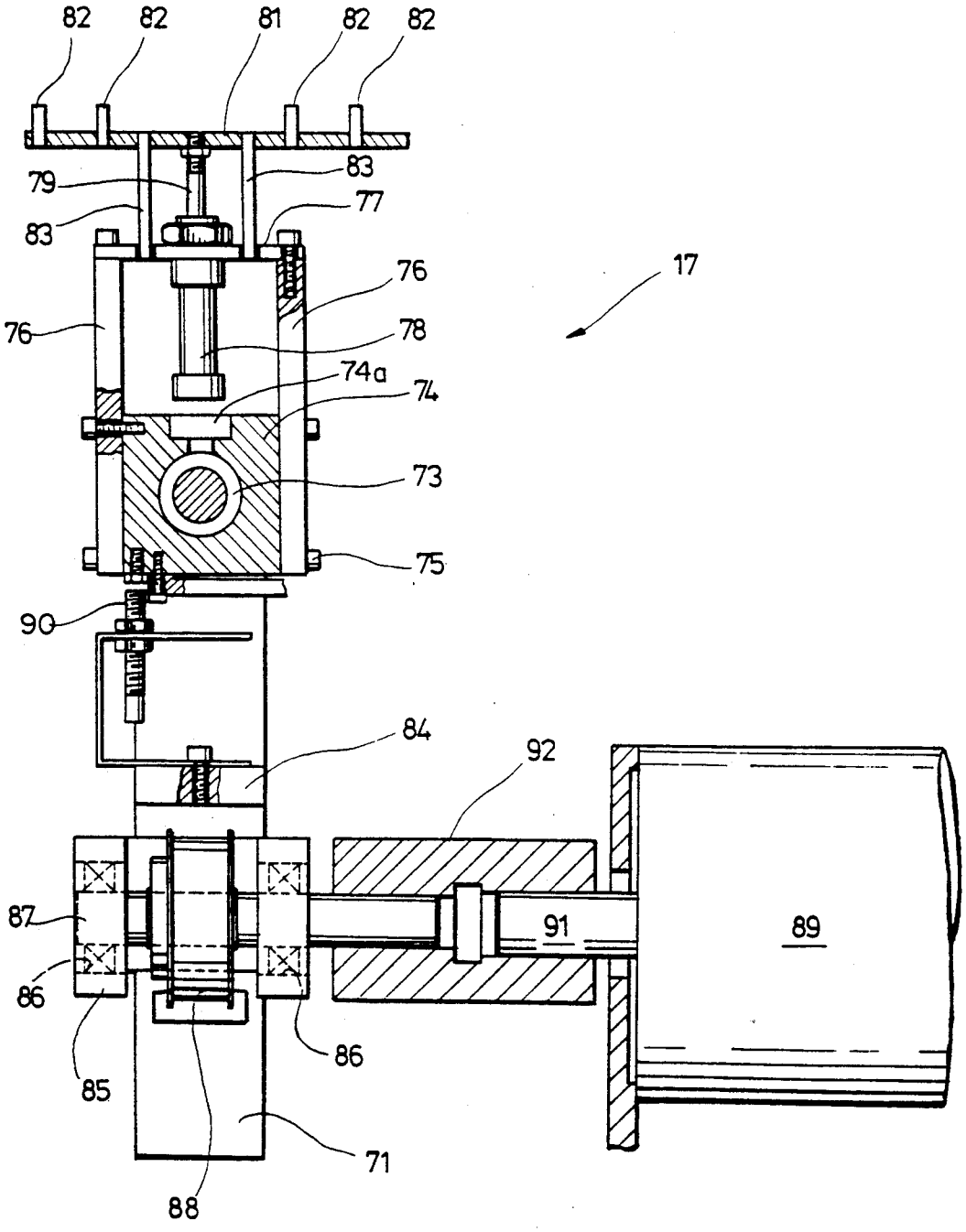
FIG. 6 is a side view, partly in section, of the stop arrangement of FIG. 5, rotated 90° with respect to FIG. 5, and omitting elements not necessary for an understanding of the association thereof.

The movable stop system is shown in detail in FIGS. 5 and 6, to which reference will be made.

Two support carriers 71 are located beneath the transport system 12, positioned parallel and spaced from each other in a direction of the transport belts 21. They extend upwardly towards the belt 21. A guide rail 72 which, for example, may be a cylindrical pipe, connects the supports 71. A slider 74, secured to a ball guide block 73, can slide longitudinally, without play, and parallel to the axis of rotation 23 of the drum 22, that is, longitudinally in the same direction as the transport path formed by the transport system 12. A headed pin 74*a* (FIG. 6) engages in a guide groove formed in the rod or pipe 72 to prevent rotation of the ball guide block or sleeve 73. Two support plates or other similar elements 76, secured to the slider 74 by screws 75, extend upwardly from the slider. The free ends of the supports 76 are coupled by a yoke 77. An operating cylinder 78 is coupled to the yoke 77, extending, with clearance, above the upper side of the slider 74. The piston rod 79 of the piston cylinder extends vertically, and hence at right angles to the axis of rotation 23, and is adjustable with respect to the support rod or pipe 72. The free ends of the piston rod 79 carries a cross bar 81 on which a plurality of stops 82 are secured, projecting upwardly. Four stops are suitable, as shown. The stops 82, forming abutment pins or the like, are in a transverse rows, extending at right angles to the transport movement of guide elements 2 being transported by the transported belt system 12.

Two downwardly extending pins 82 pass through bores in the yoke 77 and ensure that the bar or rod 81 will retain its position at right angles to the transport direction, and prevents rotation or twist of the bar or rod 81. It provides for precise alignment of the position of guide elements 2 with respect to the transport direction, and hence with respect to the drum 22.

A reinforcement bar 84 is located below the guide rail or pipe 72, secured at its end to the supports 71, for example by screw connections as shown. The bar 84 also supports an inductive position sensing switch 90—shown only in FIG. 6—which transmits information regarding the position of the slider 74 on the guide bar or rail 72, and transmits this information to a central control unit CU, shown only schematically in FIG. 2. When the slider 74 has a predetermined position, the sensor 90 emits an appropriate signal.

Movement of the slider 72 is controlled by a motor 89 driving a gear belt 88'. A bearing block 85 (FIG. 6) is attached to one of the supports 71, in which a drive shaft 87 is journalled by two ball bearings 86. The bearing block 85 is below the bar 84.

A gear or sprocket 88 is coupled to the drive shaft 87 to rotate therewith, about which gear belt 87 is looped. For clarity, the gear belt 88' is shown only schematically in FIG. 5 by broken lines, and deflection rollers have been omitted, since they can be placed and secured as well known in engineering practice.

The drive motor 89 is a controlled motor, preferably a stepping motor, having an outer shaft 91 which is coupled by a flexible shock compensation coupling 92 with the shaft 87. The stepping motor 89 is shown only schematically in FIG. 5, and coupled to the sprocket wheel 88, as schematically shown by the broken-line connection therein.

The control unit CU, as will appear, controls the sequencing and synchronized operation of the various operating elements, that is, motors to rotate shafts, and cylinder-piston arrangements.

OPERATION

Initially, it is assumed that the drum 22 has the position shown in FIG. 2. A groove 27*a* is in alignment with a guide element 2, to be transported by the transport belts 21. A reinforcement insert 9 is within the groove 27*a*. Other reinforcements inserts are in the succeeding grooves 27*b*, 27*c*, 27*d*. Insertion of an insert into groove 27*e* will be described below.

In the position shown in FIG. 2, the drum 22 is held stationary by the drive motor 32, typically a stepping motor. Upon controlling motor 19 to rotate shaft 18, belt 21 will transport a guide element 2 in such a direction that its side edge 6 will be parallel to the axis of rotation 23 and passing through the groove 27*a*. The transport movement of the guide element 2 is stopped by the stop system 17, upon engagement of the leading or lower edge of the guide element 2 against the engagement pin 82 (FIGS. 5, 6). In this position, that region of the edge 6 of the guide element 2 which contains the printing on the tab 7 will be in alignment with the reinforcement 9 in the respective groove, as shown in groove 27*a*. FIG. 3 is a side view illustrating the position of the element 2, shown only in fragmentary form, in the groove 27*a*.

Figure 7:
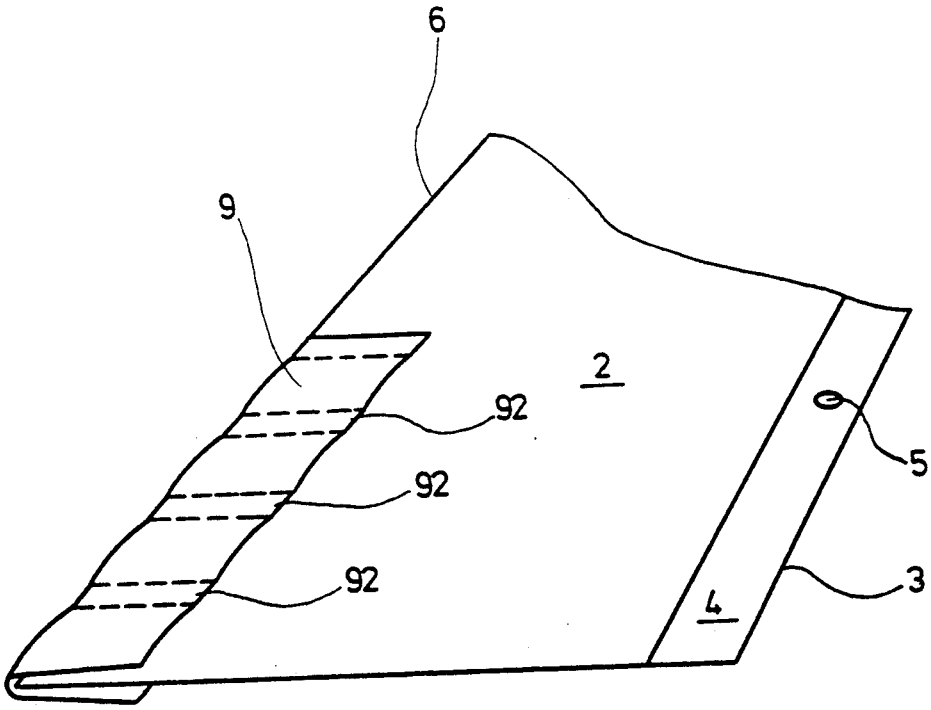
FIG. 7 is a fragmentary perspective view of a file guide immediately after leaving the apparatus of FIG. 2, and turned over 180° with respect to the representation of FIG. 2.

The central control unit CU (FIG. 2) of the system 11 now controls pivoting of the arms 61 and 67 of the application system 16. The bars 62, 66, with the tines 63, 65, are moved towards each other, engaging from the bottom and from the top in the circumferential grooves 69 of the drum 22. In this movement they simultaneously touch the folded reinforcement element 9 in the groove 27*a* and, upon further movement, press the element 9 into engagement with the upper and lower surfaces of the guide element 2, by engagement of the surfaces 64, 68 against the reinforcement 9. Each one of the surfaces 64, 68 forms a counter element or anvil for the corresponding opposite engagement surface 68, and vice versa. The application force thus provides for at least preliminary attachment of the reinforcement element 9 at various positions 92, as shown in highly schematic representation in FIG. 7.

The preliminary attachment of the reinforcement element 9 on the guide element 2, as well as the corresponding counter or anvil arrangement, will depend on the nature of the reinforcement element 9 and/or the supply strip 15 therefor. In accordance with a preferred feature of the invention, the ribbon 15 has a layer or coating of heat-responsive adhesive, so that, upon heating of the tines 63, 65, the reinforcement element 9 will be pressure-adhesively stapled to the guide element 2.

Upon preliminary attachment of the reinforcement element 9 to the guide element 2, the pivot arms 61, 67 are moved apart, so that the tines 63, 65 can leave the grooves 69 of the drum 22, although complete removal is not always necessary.

The guide element 2, with the preliminarily attached reinforcement element 9, can then be transported by the transport system 12 upon withdrawal of the abutment or stop pins 82. The cylinder-piston unit 78 (FIG. 6) is controlled to apply pressure fluid at the side of a piston within the cylinder chamber adjacent the piston rod 79 so that the piston rod 79 is withdrawn within the cylinder 78, pulling the abutment pins 82 beneath a plane defined by the upper runs of the transport belts 21. The engagement or stop or abutment pins 82 thus are removed from the path of the guide element 2 and, upon starting movement of the belts 21, the guide element 2 is transported out of the path of the drum 22 in transport direction, and thereby removed from the groove 27*a*.

Meanwhile, and while a reinforcement element 9 is placed from groove 27*a* on the guide element 2, a new reinforcement element can be placed on the diametrically opposite side in groove 27*e*. Thus, when one of the grooves 27, here 27*a*, is in reinforcement application position, an opposite groove, here groove 27*e*, is in reinforcement receiving position.

After a reinforcing element 9 has been applied to the guide element 2, the groove, of course, will be empty and empty grooves at the upper side of the drum 22—with reference to FIG. 2—will be present at the position of the groove 27*e*. Ribbon 15, after appropriate folding, is fed by the pinch rollers 58 which are rotated under control of the central control unit CU, pulling off a portion of the ribbon 15 from a supply roller, not shown, folding the portion at the folding station 54 and feeding the now V-shaped ribbon 15 through the opening 38 in the cutter plate 37 into the empty groove 27*e*. Although the ribbon 15 is folded flat together by the pinch rollers 58, it will still have a certain tendency to open up. Thus, the ribbon 15, even after folding, will have the tendency to have the legs of the folded ribbon engage the side walls of the opening 38. Folding the ribbon, additionally, provides good stability against buckling, so that the folded ribbon 15 can be readily introduced into the empty groove 27*e*. The opening 38 has a slightly greater radial distance from the axis of rotation 23 than the groove 27, so that the ribbon 15 can be pushed into the groove 27*e* without any problem.

When a predetermined length, corresponding to the length of the reinforcement element 9, has been pushed through the cutter sheet 37, the drive for the pinch rollers 58 is stopped and, instead, the cylinder-piston unit 52 is operated so that the piston rod 51 is projected. This stretches the dual lever system 45, pushing the knife blade 41 in the direction of the axis of rotation 23. The tip of the triangular knife 41—as can be clearly seen in FIG. 4—is inserted into the V-shaped region between the two legs of the folded strip 15. Each one of the legs is cut by the knife 41 on the edge of the opening 38.

At the same time, as the knife 41 cuts, the generally wedge-shaped slider 53 is moved in the direction of the groove 27 and at least a portion of the ribbon 15 extending beyond the opening 38 in the cutter plate 37 is gripped by the slider 53 and forcefully engaged in the groove 27. The forward movement of the knife 41 and of the slider 53, respectively, is terminated only when the edge of the slider 53 is almost at the root of the groove 27 of the drum 22. In this position, the edges of the completely cut reinforcement element 9, severed from the ribbon 15, are beyond the inwardly extending projections or ridges 36, 37 (FIG. 3). The V-shaped folded reinforcement element 9, due to inherent elasticity, expands so that its edges, upon withdrawal of the slider 53, will engage behind the projections or strips 35, 36, when the cylinder-piston unit 52 is operated in reverse direction to withdraw the piston rod 51 upwardly. The width of the strip or ribbon 15, before folding, must be smaller or at least only as large as the shortest path through the groove 27 along the two side walls 28, 29 thereof, that is, no longer than the sum of the lengths of the side walls 28, 29 (FIG. 3) of any one of the grooves.

The severing and insertion operation, thus, places a reinforcement element 9 in an open groove 27, and the element 9 is then retained or caught therein. It can be withdrawn in the direction of the open portion of the slit 27 only when it is compressed, that is, when it can pass over the projections 35, 36.

As explained, after projection and retraction of the knife 41, and with it of the slider 53, an initially empty groove 27 now will have anew reinforcement element 9 retained therein. Simultaneously with the insertion cycle, and as described above, a reinforcement 9 previously in a groove 27 is attached, at least preliminarily, on a guide element 2 which, then, is removed from the groove 27*a* by the guide element upon further longitudinal movement thereof.

A subsequent reinforcement element 9, to be applied to a subsequent guide element 2, can be fed to the drum 22 when, prior thereto, the drum 22 is indexed by the drive motor 32 by the spacing of the distance between two adjacent grooves 27. Thus, and upon rotation in accordance with arrow 93 (FIG. 2), a groove 27*b* in which, previously, a reinforcement element 9 has been inserted, will be placed in the transport path of a guide element 2 while, at the same time, an empty groove 27*f* will be placed in position to receive an end portion of the ribbon 15 which will form another reinforcement element 9.

The grooves 27, and specifically grooves 27*f* and 27*e*. in the embodiment shown, and at the upper side of the drum, are empty, and do not retain reinforcements 9; the reinforcements 9 are filled in the grooves at the lower side, that is, grooves 27*b*, 27*c*, 27*d*.

In addition to rotating the drum 22 by one index distance, corresponding to the spacing between adjacent grooves 27, the stop arrangement 17 is readjusted since succeeding guide elements 2 will have the tabs 7 at different positions along the edges 6 thereof.

The guide elements, particularly if alphabetized, and which are to form a complete set, are thus produced sequentially. Due to stacking of a set, it is customary to start with the guide element 1 which, in the finished set, forms the lowest guide element. In a complete alphabetical set from "A" to "Z" of guide elements 1, it is best to start with the letter "Z", and to produce the last guide element of the set with the tab 7 carrying the symbol "A". This requires movement of the stop elements 82 of the stop or abutment system 17, upon handling of a set, to move farther and farther away from the drum 22 in the transport direction of the guide element blanks 2. In any event, the respective guide element 2 is stopped by the stop system 17 always at the point when the tab 7, the position of which will depend on the position and nature of the symbol printed thereon, is in alignment with the reinforcement 9 in the drum 22.

The stepping motor 89 (FIGS. 5, 6) is started to move the stop elements 85 in sequence, by moving the gear belt 88' coupled to the slider 84 in accordance with the spacing between two adjacent tabs 7, away from the drum 22. The spacing between tabs is that dimension which is measured when two finished guide elements 1 with succeeding symbols are located above each other.

As soon as the slider 74 for the subsequent guide element 1 has reached the appropriate position, motor 89 is stopped, and the slider 74 likewise will stop. The central control unit CU then controls the pressure cylinder 78 to move the bar 81 upwardly so that the engagement pins 82 will come in interfering position with respect to the transport path of the guide blanks 2. The transport system 12 can now be started by starting motor 19 in order to supply the next blank, with the appropriate tab symbol, to the reinforcement system 11 and, specifically, to the application system 13. The blank 2 is held in appropriate position, in which the tab 7 faces the reinforcement 9 to be applied thereto and held in the groove 27 facing the blank 2. The cycle, thus, can repeat.

The drum 22 can be rotated in the interval after a reinforced blank 2 has left the region of the drum and just before the leading edge of a subsequent blank 2 reaches the next indexed groove with a reinforcement element 9 therein.

After preliminary attachment, for example by thermosensitive adhesion, of the reinforcement element 9, the reinforcement element 9 can be completely adhered, for example by passing it between heated pinch rollers, as well known, and then to a punching press in which the tab portion, as seen in FIG. 1, is punched. To properly align the punching press with the position of the tab with respect to a transverse edge of the guide element, a movable stop system, similar to the movable stop system 17, can be used.

Introducing the reinforcement into the gripper drum 22 is facilitated by the wedge-shaped element 53 coupled to the knife 41. The preformed reinforcement ribbon 15, thus, need not be introduced into the groove from the outer, open side thereof, but, rather, can be slid into the groove and then pressed therein by the wedge-shaped pressing element 53. This arrangement reliably prevents engagement and interference of the ribbon 15 with the edges of the groove adjacent the end wall 25, while further simplifying the arrangement of the cutter system 14. Feeding the reinforcement as a continuous ribbon from a supply spool and then cutting it to size permits introducing the cut element effectively simultaneously with its production, that is, cutting. The arrangement permits, in a simple manner, synchronizing the insertion push movement of the pusher 53 and of the knife, as described, by merely attaching the pusher element 53 to the knife itself. This, further, reliably prevents drop-out of the reinforcement cut from the ribbon 15, especially if, as described, the ribbon is completely severed into the element 9 only after a portion thereof has already been received within the groove **27*e* of the drum 22**.

The arrangement is particularly compact and requires little space if, as described, the insertion position for the reinforcement element is 180° from the application position, as shown by the grooves **27*e* and 27*a*, so that a simple rotation of the gripper drum 22** is all that is needed.

Folding the ribbon 15, and pinching it between pinch rollers 58, prevents complete opening of the fold formed by the folding apparatus 57, while permitting sufficient opening to ensure entry of the pointed triangular knife 41. A single fold, as shown, is sufficient and provides for appropriate stiffness of the ribbon which, otherwise, may be limp, to permit insertion into the respective empty groove by a pushing operation.

Cutting plastic ribbons usually causes burrs or cutting curls to arise. To prevent such burrs or curls holding the ribbon closed, which may make the projections 35, 36 (FIG. 3) at the edges of the grooves ineffective, a cutter system which is formed of a cutting plate 37 with an opening through which the folded ribbon fits, coupled with a knife which is triangular and pointed, has the advantage that cutting burrs or curls will be outside of the folded edges, and thus not interfere, after cutting, with each other.

The operating clock rate or cadence time is particularly short if the gripper arrangement for the reinforcement element 9, as shown, is a drum which carries a plurality of uniformly spaced grooves on its circumference, extending axially in parallel to the axis of rotation. It is then only necessary to index the drum by the distance between adjacent grooves which, in one operation, places an empty groove in the reception position in alignment with the ribbon 15 while a reinforcing element 9 can be adhered to a guide blank 2.

The attachment system 16 ensures application and secure attachment and adhesion of the reinforcement on the blank 2 prior to a final attachment thereof. Even comparatively long or extensive reinforcement portions can be reliably attached, even if only preliminarily. The projecting tines or comb-like fingers 63, 65, engaging through circumferential grooves 69 of the drum 22, ensures that, due to the intersection of the grooves 69 and 27, at least preliminary seam lines 92 (FIG. 7) will be formed. The circumferential grooves 69, operatively associated with the tines 63, 65, permit fitting an entire reinforcement element 9 within the drum 22, and not requiring projection of any portion of the reinforcement element from the drum.

Indexing the drum by one index rotary movement is simple, precise and does not require reversal of direction of movement.

The movable stop system 17 in the path of the guide blanks 2 is so arranged that the masses to be moved are a minimum. The stop pins 82 have low weight and can be rapidly adjusted up and down with minimum power requirement. The gripper system 13 and the drum 22 can be stationary in axial or translatory direction since the portion of the blank 2 which does not have the reinforcement thereon can be fed through the groove and beyond the drum 22. Drum 22, thus, only need rotate and not move otherwise.

The stop pins 82 are movable in two directions—one direction being the position adjustment direction which places the entire blank 2 in appropriate position to receive the reinforcement on the tab, wherever it may be positioned, and in accordance with, for example, an alphabetical indication thereof. The other movement is perpendicular to that path, so that, in a projected position, the pins 82 interfere with movement of the blank 2 and hold it in a fixed position, whereas, in a non-interfering position, the frictional supply belts 21 can remove the now reinforced blank from the region of the drum 22. The friction belt system 12 thus ensures that the blank 2 is properly positioned when the reinforcement 9 is applied by being pressed with some force, by providing frictional carry-on force between the transport belts and the respective guide blank 2 against the engagement pins 82.

Guiding the engagement pins 82 by mounting them on a slider beneath the transport path of the blanks 2 as determined by the belt 21, and in a direction parallel to the transport path, has the advantage that only low masses need be moved, and adjustment of the position of the pins 82 for succeeding guide blanks 2 of a set requires only short movement of the slider. The slider movement is controlled by a controlled drive motor, preferably a stepping motor, in order to bring the stop pins 82 in the appropriate position for application of the reinforcement element 9. The slider carries the lifting system which raises and lowers the pins 82. Preferably, and in order to provide inclination or slanting or skew of a blank 2, and to uniformly distribute the frictional force of the respective blanks and the belt 21, a plurality of pins 82 are, preferably, provided located on a common cross bar 81 which can easily be guided precisely perpendicularly to the transport path by guide pins 83 fitting into openings or guide bushings of the cross elements 77 attached to the support plates, rods or other suitable elements 76.

Various changes and modifications may be made, and any features described herein may be used with any of the others, within the scope of the inventive concept.

I claim:

1. Apparatus to apply reinforcement elements (9) on index tabs (7) of file guides (1) having a transport means (12) for moving file guide stock material (2) along a predetermined transport path;

a reinforcing ribbon (15) and a supply means (54) for supplying the reinforcing ribbon about an edge of the file guide stock material (2);

means (13) for joining a portion of the reinforcing ribbon (15) about an edge of the file guide stock (2), said joining means being located along said predetermined transport path, comprising, in accordance with the invention, gripper means (22) rotatable about an axis (23), said gripper means including a rotatable base body formed with at least one axially extending groove (27) in the circumference of the base body, said at least one groove defining two opposite edge portions (33, 34) adjacent the circumference of the base body and extending parallel to said axis (23);

controlled moving means (32) coupled to said gripper means (22) for moving the gripper means between a receiving position in which said at least one groove (27) of the gripper means (22) is operatively associated with the reinforcing ribbon (15) to receive the reinforcing ribbon in said groove, and a delivery position in which said at least one groove (27) of the gripper means (22) is in the transport path of the stock material (2); and an application means (16) for applying the ribbon in the groove (27) of the gripper means (22) on and over the edge of the file guide stock material (2).

2. The apparatus of claim 1, wherein said at least one groove (27, 27*a* . . . 27*f*) is, in cross section, essentially V-shaped.

3. The apparatus of claim 1, wherein said at least one groove (27, 27*a* . . . 27*f*) has edge portions (33, 34) formed with facing projections or ribs (35, 36).

4. The apparatus of claim 1, further including an insertion push element (53) located in the region of the receiving position, said insertion push element having a component of movement directed towards and into said at least one groove (27, 27*a* . . . 27*f*) for selectively pushing said ribbon (15) into said at least one groove.

5. The apparatus of claim 1, further including a cutter (14) located between said supply means (54) for said ribbon (15) and said gripper means (22) for cutting the reinforcement element (9) off said reinforcing ribbon (15), said cutter including a fixed cutter plate (37) and a movable cutter knife (41).

6. The apparatus of claim 4, further including a cutter (14) located between said supply means (54) for said ribbon (15) and said gripper means (22) for cutting a reinforcement element (9) off said reinforcing ribbon (15), said cutter including a fixed cutter plate (37) and a movable cutter knife (41); and wherein said insertion push element (53) is coupled to said knife (41).

7. The apparatus of claim 1, wherein the axis of rotation (23) about which said gripper means (22) is rotatable is a fixed axis.

8. The apparatus of claim 1, wherein said receiving position of the gripper means and said delivery position are 180° diametrically opposite each other with respect to said axis (23).

9. The apparatus of claim 1, further including cutter means (14) severing said reinforcing ribbon (15) to provide the reinforcing elements (9);

and wherein the reinforcing elements (9) have a width which is at most up to the length of the depth of the walls defining said groove from one edge (33) of one wall to the root of the groove and up to the other edge (34) of the groove.

10. The apparatus of claim 1, wherein said supply means (54) for the ribbon (15) includes means (56, 57, 58) for longitudinally folding said ribbon to assume essentially, in cross section, V-shape.

11. The apparatus of claim 10, further including a cutter (14) located between said supply means (54) for said ribbon (15) and said gripper means (22) for cutting a reinforcement element (9) off said reinforcing ribbon (15), said cutter including a fixed cutter plate (37) and a movable cutter knife (41);

and wherein said cutter plate (37) is formed with an opening (38) of essentially V-shape, with the apex of the V facing said axis of rotation (23) of the gripper means.

12. The apparatus of claim 10, further including cutter means (14) having a knife (41) which, in a plane perpendicular to the axis of rotation (23) of the gripper means (22), has a triangular shape, with the apex of the knife facing the axis of rotation (23) of the gripper means (22).

13. The apparatus of claim 1, further including cutter means (14) including a knife (41), and operating means (44–52) coupled to the knife and imparting reciprocating motion to the knife towards and away from said axis of rotation (23) of the gripper means.

14. The apparatus of claim 10, further including cutter means (14) having a knife (41) which, in a plane perpendicular to the axis of rotation (23) of he gripper means (22), has a triangular shape, with the apex of the knife facing the axis of rotation (23) of the gripper means (22);

and wherein said essentially V-shaped knife engages between and into the fold of the ribbon (15) to sever the ribbon into the reinforcing elements (9).

15. The apparatus of claim 1, wherein said base body of the gripper means (22) comprises a cylinder or drum defining a circumferential surface (26) and two end surfaces (24, 25), the axis of rotation (23) forming the longitudinal axis of the cylinder or drum, and said at least one groove (27, 27*a* . . . 27*f*) is formed at the circumferential surface (26) and parallel to the axis of rotation (23).

16. The apparatus of claim 15, further including a cutter means (14) located adjacent one of the end faces (25) of said cylinder or drum.

17. The apparatus of claim 15, wherein a plurality of grooves (27, 27*a* . . . 27*f*) are formed in the circumferential surface (26) of the drum, said plurality of grooves being uniformly distributed about the circumference, and all having essentially similar cross sections.

18. The apparatus of claim 1, wherein said application means (16) is located adjacent said gripper means (22) and positioned for engagement against said stock material (2) in the region of the index tabs (7) and on and against a reinforcing element (9) positioned in said at least one groove (27 . . . 27*a* . . . 27*d*) of the gripper means.

19. The apparatus of claim 18, wherein said application means comprises a welding or bonding means.

20. The apparatus of claim 18, wherein said application means comprises two sets of projecting elements or tines (63, 65), movable with respect to each other from opposite sides of the stock material and engageable with the reinforcing element (9) from both sides of the stock material.

21. The apparatus of claim 15, wherein said application means comprises two sets of projecting elements or tines (63, 65), movable with respect to each other from opposite sides of the stock material and engageable with the reinforcing element (9) from both sides of the stock material;

and wherein said cylinder or drum is formed with circumferential grooves (69) aligned with the projecting elements or tines (63, 65), said projecting elements or tines being positioned for passage through said circumferential grooves and intersecting with said at least one groove (27, 27*a* . . . 27*f*).

22. The apparatus of claim 21, wherein said circumferential grooves (69) in the cylinder or drum (22) and the projections or tines (63, 65) are uniformly axially spaced.

23. The apparatus of claim 15, wherein said at least one groove (27, 27*a* . . . 27*f*) is open at at least one of said end faces (24, 25).

24. The apparatus of claim 15, wherein said at least one groove (27, 27*a* . . . 27*f*) is positioned in said transport path at a side portion thereof; and wherein said transport means moves a stock file guide (2) in said path to place the tab of the stock file guide in said at least one groove (27, 27*a*).

25. The apparatus of claim 16, including a control unit (CU) controlling operation of said transport means (12);

rotation of said cylinder or drum;

operation of said application means (16); and operation of said cutter means (14), essentially simultaneously with operation of said application means.

26. The apparatus of claim 1, wherein said transport means (12) includes a movable friction transport device (21) for transporting the stock material in said predetermined path (2);

movable stop means (17) located in said transport path of the stock material for stopping the stock material when the tab (7) reaches the vicinity of said joining means, and including abutment means (82) movable between an interfering position in said transport path and a release or non-interfering position; and controlled positioning means (88', 88, 89) coupled to said abutment means for positioning the abutment means in a direction parallel to said transport path to determine the specific position of the stock material with respect to the joining means to permit individual application of the reinforcing elements (9) severed from said reinforcing ribbon (12) to index tabs (7) at respective selectively different positions on said stock material (2).

27. The apparatus of claim 26, wherein said movable friction transport device comprises at least one endless belt (21) having an operating run, movable in the direction of said predetermined transport path and frictionally retaining said file guide stock material thereon for transporting said stock material towards said joining means.

28. The apparatus of claim 26, wherein said controlled positioning means (88', 88, 89) includes guide means (72) extending along the direction of said predetermined transport path and a slider (74) slidable on said guide means, said slider carrying said abutment means (17, 82).

29. The apparatus of claim 28, wherein said controlled positioning means comprises a drive means (89, 91) positioning said abutment means, in steps, at predetermined positions with respect to said joining means.

30. The apparatus of claim 29, wherein said drive means comprises a stepping motor.

31. The apparatus of claim 28, further including a lifting means (78) to said abutment means (82) for moving the abutment means between said interfering and non-interfering positions.

32. The apparatus of claim 31, wherein said lifting means moving said abutment means (82) comprises a cylinder-piston arrangement having a movable element (79), and said abutment means comprises at least one stop element (82) secured to said movable element (79).

33. The apparatus of claim 26, wherein said abutment means (82) comprises at least two stop elements positioned transversely to said transport path and spaced from each other.

34. The apparatus of claim 33, further including a cross member (81) coupling said stop elements;

and operating means (78, 79) moving said cross member to position said stop elements in, respectively, interfering and non-interfering position.

35. The apparatus of claim 34, further including means (74*a*) determining the position of said cross element (81) to be perpendicular with respect to said predetermined transport path.

36. The apparatus of claim 26, wherein said at least one groove (27, 27*a* . . . 27*f*) is positioned in said transport path at a side portion thereof; and wherein said transport means moves a stock file guide (2) in said path to place the tab of the stock file guide in said at least one groove (27, 27*a*).

37. Apparatus to apply reinforcement elements (9) on index tabs (7) of file guides (1) having a transport means (12) for moving file guide stock material (2) along a predetermined transport path;

means (13) for joining the reinforcement element about an edge of the file guide stock material (2), said joining means being located along said predetermined transport path, comprising, in accordance with the present invention, means (17) for positioning said stock material relative to said joining means (13) at selected positions corresponding to staggered positions of index tabs (7) on succeeding file guides (1), including movable stop means (17) located in said transport path of the stock material for stopping the stock material when the tab (7) reaches the vicinity of said joining means, and including abutment means (82) movable between an interfering position in said transport path and a release or non-interfering position; and controlled positioning means (88', 88, 89) coupled to said abutment means for positioning the abutment means in a direction parallel to said transport path to determine the specific position of the stock material with respect to the joining means to permit individual application of the reinforcing elements (9) severed from a reinforcing ribbon (15) to index tabs (7) at respective selectively different positions on said stock material (2); and wherein said transport means (12) includes a movable friction transport device (21) for transporting the stock material in said predetermined path (2).

38. The apparatus of claim 37, wherein said movable friction transport device comprises at least one endless belt (21) having an operating run, movable in the direction of said predetermined transport path and frictionally retaining said file guide stock material thereon for transporting said stock material towards said joining means.

39. The apparatus of claim 37, wherein said controlled positioning means (88', 88, 89) includes guide means (72) extending along the direction of said predetermined transport path and a slider (74) slidable on said guide means, said slider carrying said abutment means (17, 82).

40. The apparatus of claim 37, wherein said controlled positioning means comprises a drive means (89, 91) positioning said abutment means, in steps, at predetermined positions with respect to said joining means.

41. The apparatus of claim 37, wherein said drive means comprises a stepping motor.

42. The apparatus of claim 39, further including a lifting means (78) to said abutment means (82) for moving the abutment means between said interfering and release or non-interfering positions.

43. The apparatus of claim 42, wherein said lifting means moving said abutment means (82) comprises a cylinder-piston arrangement having a movable element (79), and said abutment means comprises at least one stop element (82) secured to said movable element (79).

44. The apparatus of claim 37, wherein said abutment means (82) comprises at least two stop elements positioned transversely to said transport path and spaced from each other.

45. The apparatus of claim 44, further including a cross member (81) coupling said stop elements;

and operating means (78, 79) moving said cross member to position said stop elements in, respectively, interfering and non-interfering position.

46. The apparatus of claim 45, further including means (74a) determining the position of said cross element (81) to be perpendicular with respect to said predetermined transport path.

47. A method of applying reinforcing elements (9) on index tabs (7) of file guides (1) comprising the steps of guiding stock material (2) which will form said file guides along a predetermined transport path;

providing a reinforcing ribbon (15) having a width sufficient to fold the reinforcing ribbon about an edge of the stock material (2);

longitudinally folding the ribbon;

inserting the ribbon into a groove (27, 27a . . . 27f) of a rotatable gripper means (22);

severing the folded ribbon adjacent the rotatable gripper means, to form said insert (9) severed from the folded ribbon, and positioning said insert (9) in said groove;

rotating the gripper means to place the groove in alignment with said transport path;

feeding said stock material in said transport path and, with an edge thereof, into said groove with the reinforcing element positioned therein;

stopping feeding movement at a predetermined position corresponding to the position of the index tab; and adhering the reinforcing element about the edge of said stock material at the position of the index tab.

48. The method of claim 47, wherein said rotatable gripper means (22) has an even plurality of grooves (27, 27a . . . 27f) distributed about the circumference thereof;

and wherein said step of severing the folded ribbon (15) to form said reinforcement element is carried out essentially simultaneously with the step of applying the reinforcing element in a groove positioned diametrically opposite the groove in which a new reinforcement element has been introduced after severing from the ribbon; and then removing the stock material with the reinforcement element applied from the groove, and indexing said cylinder or drum by the position of one groove to place a reinforcement element into alignment with said transport path and an empty groove in alignment with said folded ribbon.

49. The method of claim 47, wherein said step of applying the reinforcing element (9) on said stock material in the position of said tab (7) comprises applying a tacking or stapling device against said reinforcing element (9) while it is positioned in said groove, and thereby releasing said reinforcing element from retention in said groove.

50. The method of claim 47, wherein the step of folding the ribbon comprises providing a ribbon having inherent elasticity;

folding said ribbon longitudinally to form a longitudinal crease, said ribbon, after folding and creasing, resiliently opening into essentially V-shape;

and severing said V-shaped ribbon by engaging a knife (41) having a pointed tip into said V-shaped ribbon to sever the ribbon and form said reinforcing element.

51. The method of claim 50, further including the step of positively inserting and seating the severed reinforcing element in said at least one groove.

52. The method of claim 51, including the step of positively retaining said severed reinforcing element in said groove.

* * * * *